US008240823B2

(12) United States Patent
Murakami et al.

(10) Patent No.: US 8,240,823 B2
(45) Date of Patent: Aug. 14, 2012

(54) LIQUID DROPLET EJECTING APPARATUS

(75) Inventors: Atsushi Murakami, Kanagawa (JP); Masaki Kataoka, Kanagawa (JP); Tetsuzo Kadomatsu, Kanagawa (JP); Hiroshi Shibata, Kanagawa (JP)

(73) Assignees: Fuji Xerox Co., Ltd., Tokyo (JP); Fujifilm Corporation, Tokyo (JP)

( * ) Notice: Subject to any disclaimer, the term of this patent is extended or adjusted under 35 U.S.C. 154(b) by 356 days.

(21) Appl. No.: 12/725,608

(22) Filed: Mar. 17, 2010

(65) Prior Publication Data

US 2011/0074892 A1 Mar. 31, 2011

(30) Foreign Application Priority Data

Sep. 30, 2009 (JP) ..... 2009-228769

(51) Int. Cl.
*B41J 2/175* (2006.01)

(52) U.S. Cl. ..... 347/85; 347/6; 347/17; 347/89

(58) Field of Classification Search ..... 347/14, 347/17–19, 22, 32, 6, 54–57, 66–67, 85, 347/92, 89
See application file for complete search history.

(56) References Cited

U.S. PATENT DOCUMENTS

| | | | | |
|---|---|---|---|---|
| 7,850,290 | B2 * | 12/2010 | Nitta et al. | 347/85 |
| 8,070,248 | B2 * | 12/2011 | Ogama | 347/14 |
| 2007/0216739 | A1 * | 9/2007 | Uchida et al. | 347/85 |
| 2011/0050794 | A1 * | 3/2011 | Koike et al. | 347/22 |

FOREIGN PATENT DOCUMENTS

| | | |
|---|---|---|
| JP | 11-091137 | 4/1999 |
| JP | 2005-349843 | 12/2005 |

* cited by examiner

*Primary Examiner* — Ellen Kim
(74) *Attorney, Agent, or Firm* — Fildes & Outland, P.C.

(57) ABSTRACT

A liquid droplet ejecting apparatus including: plural liquid droplet ejecting portions; supply-side individual flow paths; discharge-side individual flow paths; a supply-side common flow path; a discharge-side common flow path; first opening/closing mechanisms; second opening/closing mechanisms; a first pressure applying portion; a second pressure applying portion; a first circulating path; a third opening/closing mechanism; a second circulating path including an upstream end portion being connected to the supply-side common flow path further downstream than a connecting portion of a supply-side individual flow path connected to the supply-side common flow path at a furthest upstream side in a liquid circulating direction and a downstream end portion being connected to the discharge-side common flow path, and circulating the liquid between the supply-side common flow path and the discharge-side common flow path; and a fourth opening/closing mechanism, is provided.

8 Claims, 9 Drawing Sheets

IN A CASE WHERE DISCHARGE-SIDE COMMON FLOW PATH IS PRESSURIZED

IN A CASE WHERE INK FLOWS FROM MODULE TO DISCHARGE-SIDE COMMON FLOW PATH

IN A CASE WHERE FLOW OR PRESSURE DIFFERENCE IS NOT GENERATED

LIQUID DROPLET EJECTING APPARATUS

CROSS-REFERENCE TO RELATED APPLICATIONS

This application is based on and claims priority under 35 USC 119 from Japanese Patent Application No. 2009-228769 filed on Sep. 30, 2009.

BACKGROUND

Technical Field

The invention relates to a liquid droplet ejecting apparatus.

SUMMARY

According to an aspect of the invention, there is provided a liquid droplet ejecting apparatus including: plural liquid droplet ejecting portions, each including a supply port supplying a liquid from outside and a discharge port discharging the liquid supplied through the supply port, and each ejecting the liquid supplied through the supply port as liquid droplets; supply-side individual flow paths being connected to the respective supply ports of the plural liquid droplet ejecting portions and allowing the liquid to flow to the supply ports; discharge-side individual flow paths being connected to the respective discharge ports of the plural liquid droplet ejecting portions and allowing the liquid discharged from the discharge ports to flow; a supply-side common flow path connecting with the plural supply-side individual flow paths and allowing the liquid to flow to the plural supply-side individual flow paths; a discharge-side common flow path connecting with the plural discharge-side individual flow paths and allowing the liquid from the plural discharge-side individual flow paths to flow; first opening/closing mechanisms being disposed in the plural supply-side individual flow paths and opening/closing the plural supply-side individual flow paths; second opening/closing mechanisms being disposed in the plural discharge-side individual flow paths and opening/closing the plural discharge-side individual flow paths; a first pressure applying portion being disposed in the supply-side common flow path and applying pressure to the supply-side common flow path; a second pressure applying portion being disposed in the discharge-side common flow path and applying pressure to the discharge-side common flow path; a first circulating path circulating the liquid between the supply-side common flow path and the discharge-side common flow path; a third opening/closing mechanism being disposed in the first circulating path and opening/closing the first circulating path; a second circulating path including an upstream end portion being connected to the supply-side common flow path further downstream than a connecting portion of a supply-side individual flow path connected to the supply-side common flow path at a furthest upstream side in a liquid circulating direction and a downstream end portion being connected to the discharge-side common flow path, and circulating the liquid between the supply-side common flow path and the discharge-side common flow path; and a fourth opening/closing mechanism being disposed in the second circulating path and opening/closing the second circulating path.

BRIEF DESCRIPTION OF THE DRAWINGS

Exemplary embodiments of the invention will be described in detail based on the following figures, wherein.

DETAILED DESCRIPTION

Examples of the exemplary embodiments of the present invention will now be described based on the accompanying drawings.

First Exemplary Embodiment

In the first exemplary embodiment, as an example of a liquid droplet ejecting apparatus that ejects liquid droplets, an inkjet recording apparatus that ejects ink droplets and records an image on a recording medium will be described.

The liquid droplet ejecting apparatus is not limited to the inkjet recording apparatus. For example, the liquid droplet ejecting apparatus may be a color filter manufacturing apparatus that ejects ink onto a film or a glass to manufacture a color filter, an apparatus that ejects an organic EL solution onto a substrate to form an EL display panel, an apparatus that ejects solder in a dissolved state onto a substrate to form a component mounting bump, an apparatus that ejects a liquid containing a metal to form a wiring pattern or various film forming apparatuses that ejects liquid droplets to form a film, as long as the liquid droplet ejecting apparatus is an apparatus that ejects liquid droplets.

(Configuration of the Inkjet Recording Apparatus According to the First Exemplary Embodiment)

Figure 1:
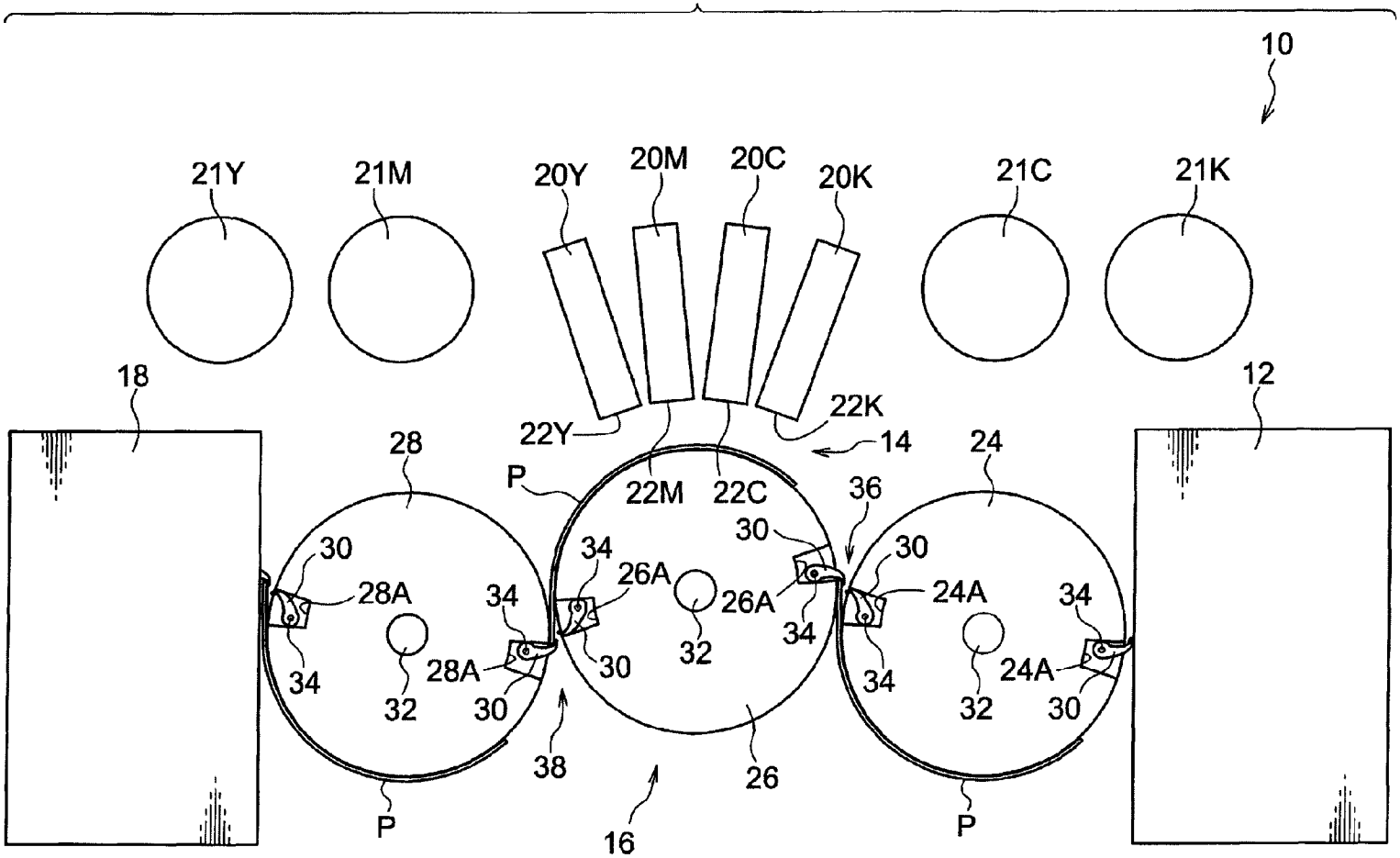
FIG. 1 is a schematic view illustrating the configuration of an inkjet recording apparatus relating to a first exemplary embodiment of the present invention.

First, the configuration of the inkjet recording apparatus relating to the first exemplary embodiment will be described. FIG. 1 schematically illustrates the configuration of the inkjet recording apparatus relating to the first exemplary embodiment.

As illustrated in FIG. 1, an inkjet recording apparatus 10 includes a recording medium accommodating portion 12 that accommodates a recording medium P, such as paper, an image recording portion 14 that records an image on the recording medium P, a conveyance portion 16 that conveys the recording medium P from the recording medium accommodating portion 12 to the image recording portion 14, and a recording medium discharge portion 18 that discharges the recording medium P on which the image is recorded by the image recording portion 14.

The image recording portion 14 includes inkjet recording heads 20Y, 20M, 20C, and 20K (hereinafter, simply referred to as 20Y to 20K) that eject ink droplets and record images on the recording medium, as an example of the liquid droplet ejecting head that ejects liquid droplets.

The inkjet recording heads 20Y to 20K respectively have nozzle surfaces 22Y to 22K wherein nozzles (not illustrated) are formed. Each of the nozzle surfaces 22Y to 22K has a recordable region whose width is equal to or more than the maximum width of the recording medium P on which an image is assumed to be recorded by the inkjet recording apparatus 10.

The inkjet recording heads 20Y to 20K are arranged in the order of colors of yellow (Y), magenta (M), cyan (C), and black (K), from a downstream side in a conveyance direction of the recording medium P. The ink droplets that correspond to the individual colors are ejected from the plural nozzles using a piezoelectric system, thereby recording an image. In the inkjet recording heads 20Y to 20K, the configuration for ejecting the ink droplets may be a configuration wherein the ink droplets are ejected using a different system, such as a thermal system.

In the inkjet recording apparatus 10, as storage portions that store liquid, ink tanks 21Y, 21M, 21C, and 21K (hereinafter, referred to as 21Y to 21K) that store inks of individual colors are provided. The ink is supplied from the ink tanks 21Y to 21K to the respective inkjet recording heads 20Y to 20K. As the ink that is supplied to the inkjet recording heads 20Y to 20K, a variety of ink, such as water-based ink, oil-based ink, solvent ink and the like, may be used.

The conveyance portion 16 includes a picking-up drum 24 that picks up the recording media P in the recording medium accommodating portion 12 piece by piece, a conveyance drum 26 serving as a conveyance object that conveys the recording media P to the inkjet recording heads 20Y to 20K of the image recording portion 14 and causes the recording surfaces (surface) of the recording medium P to face the inkjet recording heads 20Y to 20K, and a transmitting drum 28 that transmits the recording medium P on which an image is recorded to the recording medium discharge portion 18. The picking-up drum 24, the conveyance drum 26, and the transmitting drum 28 are respectively configured such that the recording medium P is held on the circumferential surface thereof by an electrostatic absorbing portion or a non-electrostatic absorbing portion using suction or adhesion.

The picking-up drum 24, the conveyance drum 26, and the transmitting drum 28 are respectively provided with two pairs of grippers 30 serving as a holding portion that nips and holds an end portion of the recording medium P at the downstream side in the conveyance direction. The drums 24, 26, and 28 are respectively configured to hold the recording media P up to two pieces in this case on the circumferential surface thereof by the grippers 30. The grippers 30 are provided in concave portions 24A, 26A, and 28A that are respectively formed on the circumferential surfaces of the drums 24, 26, and 28 two by two.

Specifically, at predetermined positions in the concave portions 24A, 26A, and 28A of the individual drums 24, 26, and 28, a rotating axis 34 is supported along a rotating axis 32 of the individual drums 24, 26, and 28, and the plural grippers 30 are fixed to the rotating axis 34 at a predetermined interval in the axial direction thereof. Accordingly, if the rotating axis 34 rotates in both a forward direction and a backward direction due to an actuator (not illustrated), the grippers 30 rotate in forward and backward directions along the circumferential directions of the individual drums 24, 26, and 28, and nip and hold or release the end portion of the recording medium P at the downstream side in the conveyance direction.

That is, f the grippers 30 rotate with distal portions thereof slightly protruding from the circumferential surfaces of the individual drums 24, 26, and 28, and due thereto, the recording medium P is delivered from the gripper 30 of the picking-up drum 24 to the gripper 30 of the conveyance drum 26 at a delivery position 36 where the circumferential surface of the picking-up drum 24 and the circumferential surface of the conveyance drum 26 face, and is delivered from the gripper 30 of the conveyance drum 26 to the gripper 30 of the transmitting drum 28 at a delivery position 38 where the circumferential surface of the conveyance drum 26 and the circumferential surface of the transmitting drum 28 face.

The inkjet recording apparatus 10 includes a maintenance unit (not illustrated) that maintains the inkjet recording heads 20Y to 20K. The maintenance unit has a cap that covers the nozzle surfaces of the inkjet recording heads 20Y to 20K, a receiving member that receives the liquid droplets to be preliminarily ejected (idly ejected), a cleaning member that cleans the nozzle surfaces, and a suction device that sucks the ink in the nozzles, and the like. The maintenance unit moves to the positions facing the inkjet recording heads 20Y to 20K and performs various maintenance operations.

The image recording operation of the inkjet recording apparatus 10 will now be described.

The recording medium P that is individually picked up by the grippers 30 of the picking-up drum 24 from the recording medium accommodating portion 12 and held is conveyed while being absorbed onto the circumferential surface of the picking-up drum 24, and is delivered from the gripper 30 of the picking-up drum 24 to the gripper 30 of the conveyance drum 26 at the delivery position 36.

The recording medium P that is held by the gripper 30 of the conveyance drum 26 is conveyed to image recording positions of the inkjet recording heads 20Y to 20K, while being absorbed onto the conveyance drum 26, and an image is formed on the recording surface by the ink droplets ejected from the inkjet recording heads 20Y to 20K.

The recording medium P wherein the image is recorded on the recording surface is delivered from the gripper 30 of the conveyance drum 26 to the grippers 30 of the transmitting drum 28, at the delivery position 38. The recording medium P that is held by the gripper 30 of the transmitting drum 28 is then conveyed while being absorbed onto the transmitting drum 28, and discharged to the recording medium discharge portion 18. As such, a series of image recording operations are performed.

(Configuration of the Ink Supply System)

Figure 2:
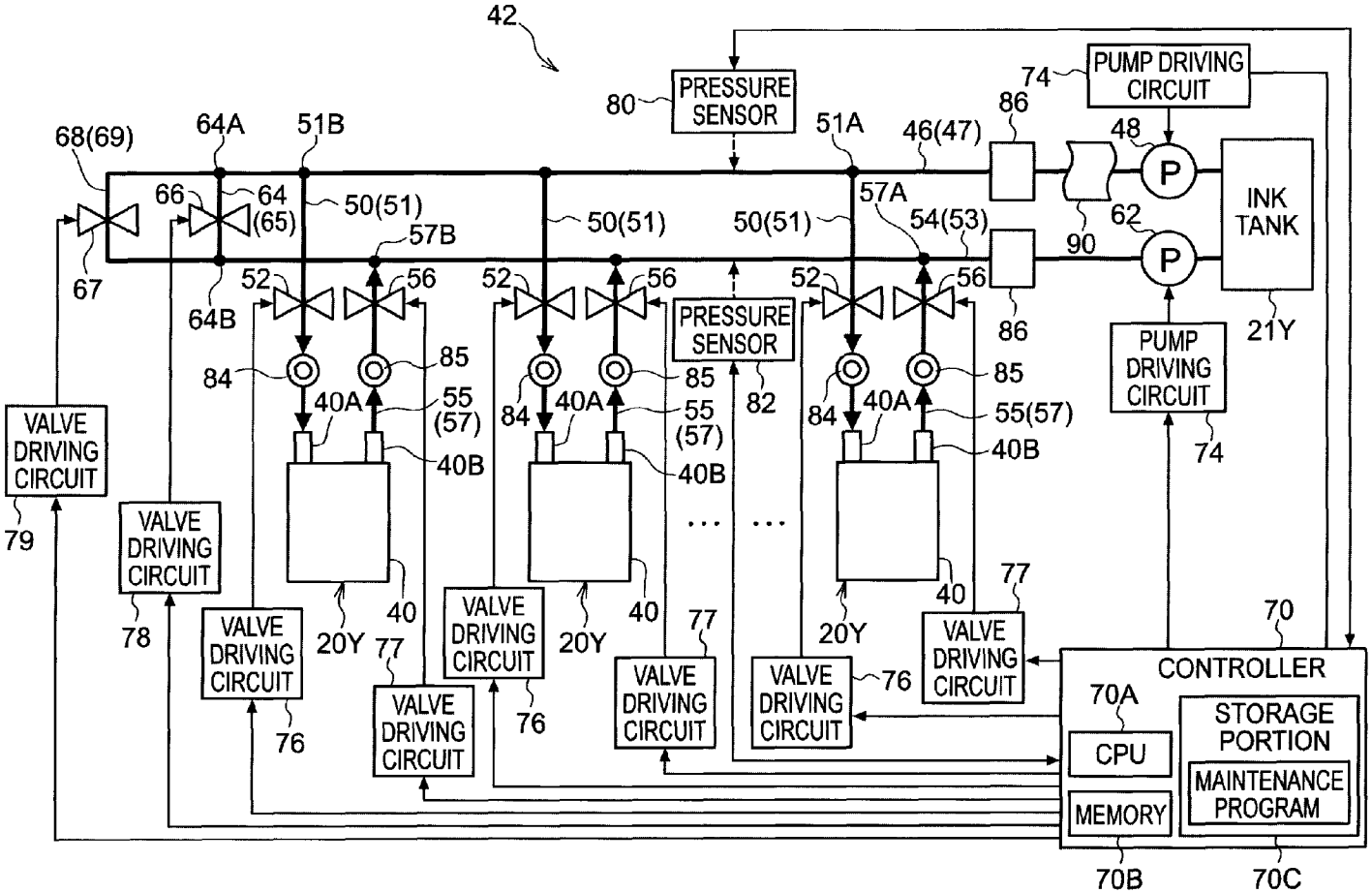
FIG. 2 is a schematic view illustrating an ink supply system relating to the first exemplary embodiment.

The configuration of the ink supply system that supplies the ink to the inkjet recording heads 20Y to 20K of the image recording portion 14 will now be described. Since the ink supply system that corresponds to each of the inkjet recording heads 20Y to 20K has the same configuration, the ink supply system that corresponds to the inkjet recording head 20Y will be hereinafter exemplified. FIG. 2 schematically illustrates an ink supply system 42 that supplies the ink to the inkjet recording head 20Y.

As illustrated in FIG. 2, the inkjet recording head 20Y includes plural ink droplet ejecting modules 40 each of which serves as a liquid droplet ejecting portion to eject the ink supplied from the outside as ink droplets.

Each of the ink droplet ejecting modules 40 is provided with a supply port 40A and a discharge port 40B. In this case, the supply port 40A may supply the ink from the outside of the ink droplet ejecting module 40 to the inside thereof, and the discharge port 40B may discharge the ink supplied through the supply port 40A from the inside of the ink droplet ejecting module 40 to the outside thereof.

Meanwhile, the ink supply system 42 includes the aforementioned ink tank 21Y that stores the yellow (Y) ink. The ink tank 21Y is connected to one end of a common tube at a supply side (hereinafter, referred to as a supply-side common tube) 46 in which the ink may circulate.

To the other end of the supply-side common tube 46, one ends of plural individual tubes 50 at the supply side (hereinafter, referred to as supply-side individual tubes), in which the ink may circulate, are respectively connected at different positions of the supply-side common tube 46. The other ends of the supply-side individual tubes 50 are respectively connected to the corresponding supply ports 40A of the plural ink droplet ejecting modules 40.

Thereby, a common flow path at the supply side (hereinafter, referred to as supply-side common flow path) 47 in which the ink may flow from the ink tank 21Y to the supply-side individual tubes 50 is formed in the supply-side common tube 46. An individual flow path at the supply side (hereinafter, referred to as supply-side individual flow path) 51 in which the ink may flow form the supply-side common flow path 47 to the supply port 40A of the ink droplet ejecting module 40 is formed in the supply-side individual tube 50.

As an example of a first opening/closing mechanism that may open and close the supply-side individual flow path 51, valves at the supply side (hereinafter, referred to as supply-side valve) 52 are respectively provided on the supply-side individual flow paths 51 (supply-side individual tube 50). When the supply-side valve 52 is in an opened state, the ink may circulate in the supply-side individual flow path 51. However, when the state of the supply-side valve 52 is switched into a closed state, the circulation of the ink in the supply-side individual flow path 51 is stopped.

As the supply-side valve 52, a solenoid valve (electromagnetic valve) that opens and closes a valve by means of a force generated by a solenoid is preferable, but different configurations including the configuration wherein the valve is opened and closed by a driving force of a motor may be used. The arrangement position of the supply-side valve 52 is not limited to the mid-flow of the supply-side individual tube 50. For example, the supply-side valve 52 may be provided at the supply port 40A of the ink droplet ejecting module 40 so as to open and close the supply port 40A.

The supply-side individual tube 50 is provided with a buffer 84 serving as a suppressing portion that suppresses a pressure fluctuation within the supply-side individual flow path 51 due to the opening/closing operation of the supply-side valve 52. The buffer 84 is disposed between the supply-side valve 52 and the ink droplet ejecting module 40, and has a function of suppressing the pressure fluctuation from propagating to the ink droplet ejecting module 40.

The supply-side common flow path 47 (supply-side common tube 46) is provided with a pump at the supply side (hereinafter, referred to as supply-side pump) 48, as an example of a first pressure applying portion that applies pressure into the supply-side common flow path 47. The supply-side pump 48 is disposed at an upstream side in an ink circulating direction, as viewed from a connecting portion 51A of the supply-side individual flow path 51 which is connected to the supply-side common flow path 47 at the furthest upstream side in the ink circulating direction.

The supply-side pump 48 may rotate in both a forward direction and a backward direction. In a case where the supply-side valve 52 is in an opened state and the supply-side pump 48 rotates in the forward direction, pressure (positive pressure) is applied to the supply-side common flow path 47, and the ink that is stored in the ink tank 21Y flows through the supply-side common flow path 47 and the supply-side individual flow path 51 and is supplied to each ink droplet ejecting module 40 via the supply port 40A of each ink droplet ejecting module 40.

One end of a common tube 54 at a discharge side (hereinafter, referred to as discharge-side common tube), in which the ink may circulate, is connected to the ink tank 21Y. To the other end side of the discharge-side common tube 54, one ends of individual tubes 55 at the discharge side (hereinafter, referred to as discharge-side individual tubes), in which the ink may circulate, are respectively connected at different positions of the discharge-side common tube 54. The other ends of the discharge-side individual tubes 55 are respectively connected to discharge ports 40B of the corresponding ink droplet ejecting modules 40.

Thereby, individual flow paths at the discharge side (hereinafter, referred to as discharge-side individual flow path) 57 wherein ink may flow from the discharge port 40B of the ink droplet ejecting module 40 to the discharge-side common tube 54 are formed in the discharge-side individual tubes 55. A common flow path at the discharge side (hereinafter, referred to as discharge-side common flow path) 53 wherein the ink may flow from the discharge-side individual flow paths 57 to the ink tank 21Y is formed in the discharge-side common tube 54.

As an example of a second opening/closing mechanism that may open and close the discharge-side individual flow paths 57, valves at the discharge side (hereinafter, referred to as discharge-side valve) 56 are respectively provided on the discharge-side individual flow paths 57 (discharge-side individual tubes 55). When the discharge-side valve 56 is in an opened state, the ink may circulate in the discharge-side individual flow path 57. However, when the state of the discharge-side valve 56 is switched into a closed state, the circulation of the ink in the discharge-side individual flow path 57 is stopped.

Like the supply-side valve 52, as the discharge-side valve 56, a solenoid valve that opens and closes a valve by means of a force generated by a solenoid is preferable, but different configurations, such as a configuration wherein the valve is opened and closed by a driving force of a motor may be used. The arrangement position of the discharge-side valve 56 is not limited to the mid-flow of the discharge-side individual tube 55. For example, the discharge-side valve 56 may be provided at the discharge port 40B of the ink droplet ejecting module 40 so as to open and close the discharge port 40B.

A buffer 85 serving as a suppressing portion that suppresses a pressure fluctuation within the discharge-side individual flow path 57 due to the opening/closing operation of the discharge-side valve 56 is provided in the discharge-side individual tube 55. The buffer 85 is disposed between the discharge-side valve 56 and the ink droplet ejecting module 40, and has a function of suppressing the pressure fluctuation from propagating to the ink droplet ejecting module 40.

As an example of a second pressure applying portion that applies pressure to the discharge-side common flow path 53, a pump at the discharge side (hereinafter, referred to as discharge-side pump) 62 is provided in the discharge-side common flow path 53 (discharge-side common tube 54). Specifically, the discharge-side pump 62 is disposed at a downstream side in an ink circulating direction, as viewed from a connecting portion 57A of the discharge-side individual flow path 57 that is connected to the discharge-side common flow path 53 at the furthest downstream side in the ink circulating direction.

Like the supply-side pump 48, the discharge-side pump 62 may rotate in both a forward direction and a backward direction. In a case where the discharge-side pump 62 rotates in the forward direction, pressure (positive pressure) is applied to the discharge-side common flow path 53.

In a case where the discharge-side pump 62 rotates in the backward direction while the discharge-side valve 56 is in the opened state, pressure (negative pressure) is applied to the discharge-side common flow path 53, and the ink is recovered from the ink droplet ejecting module 40 through the discharge-side individual flow path 57 and the discharge-side common flow path 53 to the ink tank 21Y.

As described above, in the ink supply system 42 relating to the first exemplary embodiment, a circulating path for circulating the ink is formed by the ink tank 21Y, the supply-side common flow path 47, the individual supply-side individual flow paths 51, the individual ink droplet ejecting module 40*s* of the inkjet recording heads 20Y, the individual discharge-side individual flow paths 57, and the discharge-side common flow path 53. The individual ink droplet ejecting modules 40 are disposed parallel to the circulating path.

When viewed from a connecting portion 51B of the supply-side individual flow path 51 that is connected to the supply-side common flow path 47 at the furthest downstream side in the ink circulating direction, one end of a first circulating tube 64 in which the ink may circulate is connected to the downstream side in the ink circulating direction.

When viewed from a connecting portion 57B of the discharge-side individual flow path 57 that is connected to the discharge-side common flow path 53 at the furthest upstream side in the ink circulating direction, the other end of the first circulating tube 64 is connected to the upstream side of the ink circulating direction.

Thereby, in parallel to the individual ink droplet ejecting modules 40 between the supply-side common flow path 47 and the discharge-side common flow path 53, a first circulating path 65 wherein the ink may circulate is formed in the first circulating tube 64.

As long as an upstream end portion of the first circulating tube 64 is at a downstream side in the ink circulating direction of the supply-side common tube 46 when viewed from the supply-side pump 48, the upstream end portion may be connected to any place. As long as the downstream end portion of the first circulating tube 64 is at an upstream side in the ink circulating direction of the discharge-side common tube 54 when viewed from the discharge-side pump 62, the downstream end portion may be connected to any place.

In the first circulating path 65 (first circulating tube 64), as an example of a third opening/closing mechanism that may open/close the first circulating path 65, a first circulating valve 66 is provided. In a case where the first circulating valve 66 is in an opened state, the ink may circulate in the first circulating path 65. However, in a case where the state of the first circulating valve 66 is switched into the closed state, the first circulating path 65 is closed, that is, the circulation of the ink between the supply-side common tube 46 and the discharge-side common tube 54 is stopped. As the first circulating valve 66, a solenoid valve is preferable, and the different configurations may also be used.

One end of a second circulating tube 68, in which the ink may circulate, is connected to one end portion of the supply-side common tube 46 at a side opposite to a side connected to the ink tank 20Y. That is, one end of the second circulating tube 68 is connected to the supply-side common tube 46 further downstream in the ink circulating direction than a connecting portion 64A connecting the first circulating tube 64 to the supply-side common tube 46.

The other end of the second circulating tube 68 is connected to an end portion of the discharge-side common tube 54 at a side opposite to a side connected to the ink tank 21Y. That is, the other end of the second circulating tube 68 is connected to the discharge-side common tube 54 further upstream in the ink circulating direction than the connecting portion 64B of the first circulating tube 64 to the discharge-side common tube 54.

Thereby, a second circulating path 69 wherein the ink may circulate between the supply-side common flow path 47 and the discharge-side common flow path 53 is formed in the second circulating tube 68 in parallel to each ink droplet ejecting module 40 and the first circulating path 65. An upstream end portion of the second circulating path 69 is connected to the supply-side common flow path 47 further downstream than the connecting portion 64A of the first circulating tube 64 to the supply-side common tube 46.

The flow path resistance of the second circulating path 69 is different from that of the first circulating path 65. Specifically, the flow path resistance of the second circulating path 69 is larger than that of the first circulating path 65. In the present exemplary embodiment, by changing the flow path resistances of the first circulating path 65 and the second circulating path 60, the flow path resistance of the first circulating path 65 is set to a flow path resistance that is suitable for the maintenance operation, and the flow path resistance of the second circulating path 69 is determined by the circulating flow rates of the respective modules and the temperature distributions of the ink in the supply-side common flow path 47. The flow path resistance is adjusted by the flow path length or the flow path width (diameter of the tube). The flow path resistance may be set by the valve. The setting of the flow path resistance by the valve is made on the basis of the shape of the valve at a portion where the ink circulates.

The flow path resistance in the second circulating path 69 becomes a resistance that corresponds to the four ink droplet ejecting modules 40, in a case where 17 ink droplet ejecting modules 40 are disposed to form the inkjet recording head 20Y.

As an example of a fourth opening/closing mechanism that may open/close the second circulating path 69, a second circulating valve 67 is provided in the second circulating path 69 (second circulating tube 68). In a case where the second circulating valve 67 is in an opened state, the ink may circulate in the second circulating path 69. However, in a case where the state of the second circulating valve 67 is switched into the closed state, the second circulating path is closed, that is, the circulation of the ink between the supply-side common tube 46 and the discharge-side common tube 54 is stopped. As the second circulating valve 67, a solenoid valve is preferable, and different configurations may also be used.

A sub-tank 86 is provided in the supply-side common flow path 47 (supply-side common tube 46). Specifically, the sub-tank 86 is disposed between the connecting portion 51A of the supply-side individual flow path 51 and the supply-side pump 48.

Figure 3C:
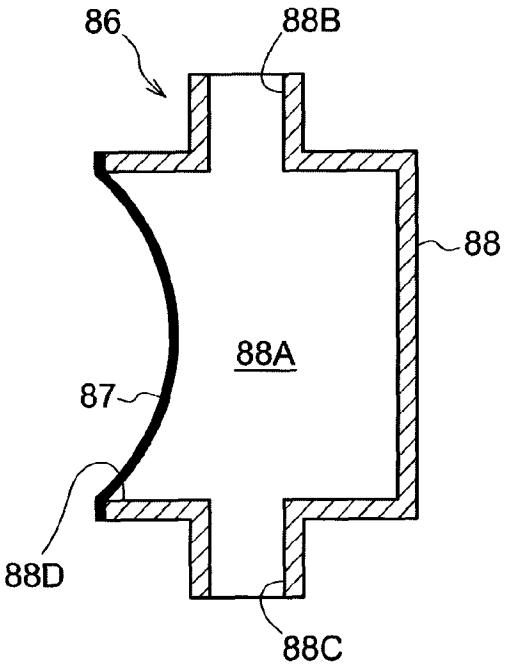
FIG. 3C is a schematic view illustrating the configuration of a sub-tank.
Figure 3B:
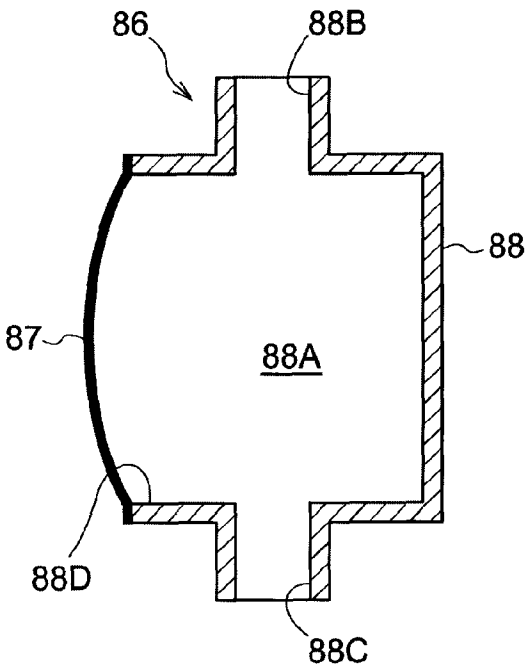
FIG. 3B is a schematic view illustrating the configuration of a sub-tank.
Figure 3A:
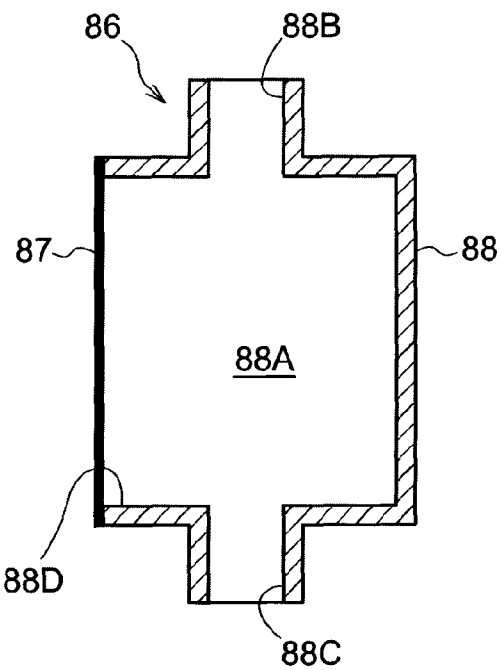
FIG. 3A is a schematic view illustrating the configuration of a sub-tank.

As illustrated in FIG. 3A, the sub-tank 86 includes a housing 88 wherein a storage portion 88A to store the ink is formed. In the housing 88, an inflow port 88B that allows the ink to flow from the supply-side pump 48 the storage portion 88A, and an outflow port 88C that allows the ink in the storage portion 88A to flow to the supply-side individual flow paths 51 side (ink droplet ejecting module 40) are formed.

In the housing 88, an opening 88D is formed laterally with respect to the circulating direction of the ink from the inflow port 88B to the outflow port 88C, and a film body 87 made of a flexible material, such as rubber, is mounted to block the opening 88D.

When the pressure increases in the supply-side common flow path 47 where the sub-tank 86 is provided, as illustrated in FIG. 3B, the film body 87 is bent to the outside of the housing 88 due to the pressure of the ink stored in the storage portion 88A of the sub-tank 86. As a result, the volume of the storage portion 88A increases, and the volume within the supply-side common flow path 47 including the storage portion 88A also increases, and accordingly, the increase amount of the pressure in the supply-side common flow path 47 including the storage portion 88A reduces.

When the pressure in the supply-side common flow path 47 decreases, as illustrated in FIG. 3C, the film body 87 is bent to the inside of the housing 88 due to a decrease in the pressure of the ink stored in the storage portion 88A of the sub-tank 86. As a result, the volume of the storage portion 88A decreases, and the volume within the supply-side common flow path 47 including the storage portion 88A also decreases, and accordingly, the decrease amount of the pressure in the supply-side common flow path 47 including the storage portion 88A reduces. Thereby, the minute change (pulsation due to the pump) of the pressure in the supply-side common flow path 47 is suppressed.

A temperature adjustor 90 is provided in the supply-side common flow path 47 (supply-side common tube 46). Specifically, the temperature adjustor 90 is disposed between the supply-side pump 48 and the sub-tank 86. The temperature adjustor 90 adjusts the temperature of the ink flowing through the supply-side common flow path 47 to a predetermined temperature.

The ink supply system 42 includes a controller 70. The controller 70 includes a CPU 70A, a memory 70B, and a non-volatile storage portion 70C that is composed of a hard disk drive (HDD) or a flash memory. a maintenance program for executing an after-mentioned maintenance process by the CPU 70A is stored in the storage portion 70C. The supply-side pump 48 and the discharge-side pump 62 are respectively connected to the controller 70 via a pump driving circuit 74, and the operations of the supply-side pump 48 and the discharge-side pump 62 are controlled by the controller 70. The individual supply-side valves 52 are connected to the controller 70 via a valve driving circuits 76, the individual discharge-side valves 56 are connected to the controller 70 via a valve driving circuits 77, the first circulating valve 66 is connected to the controller 70 via a valve driving circuit 78, and the second circulating valve 67 is connected to the controller 70 via a valve driving circuit 79. The openings/closings of the individual supply-side valves 52, the individual discharge-side valves 56, the first circulating valve 66, and the second circulating valve 67 are also controlled by the controller 70.

A pressure sensor 80 that detects the pressure of a section closer to the ink droplet ejecting module 40 side than the supply-side pump 48 in the supply-side common tube 46 is provided in the supply-side common tube 46. A pressure sensor 82 that detects the pressure of a section closer to the ink droplet ejecting module 40 than the discharge-side pump 62 in the discharge-side common tube 54 is provided in the discharge-side common tube 54. The pressure sensors 80 and 82 are connected to the controller 70, and the pressure detection results that are detected by the pressure sensors 80 and 82 are output to the controller 70.

The ink supply system 42 includes a maintenance unit (not illustrated) that is used to maintain each ink droplet ejecting module 40. The maintenance unit includes a cap that covers the nozzle surfaces of the ink droplet ejecting modules 40 of the inkjet recording heads 20Y to 20K, a receiving member that receives the ink droplets to be preliminarily ejected (idly ejected), a cleaning member that cleans the nozzle surfaces, and a suction device that sucks the ink in the nozzles. The maintenance unit may move to the positions facing the ink droplet ejecting modules 40. Although not illustrated in the drawings, the maintenance unit is also connected to the controller 70, and moves to the facing positions according to an instruction from the controller 70 and executes various maintenance processes.

Although not illustrated in the drawings, the controller 70 is connected to ejecting mechanisms that are incorporated in the inkjet recording heads 20Y to 20K (individual ink droplet ejecting modules 40), and executes an ink droplet ejecting control process of determining the nozzles to eject ink droplets and the timing of ejecting the ink droplets from the nozzles according to an image signal, and supplying a driving signal to the ejecting mechanism corresponding to the nozzles to eject the ink droplets at the determined timing. Also, the controller 70 may execute a process of controlling the whole operation of the inkjet recording apparatus 10.

(Function of the Ink Supply System 42 Relating to the First Exemplary Embodiment)

The function of the ink supply system 42 relating to the first exemplary embodiment will now be described.

In the ink supply system 42 relating to the first exemplary embodiment, the ink is circulated along the circulating path, as described below.

During a period when the maintenance is not performed (for example, image recording period when the image is recorded on the recording medium P or a waiting period where the image is not recorded), the controller 70 activates the supply-side pump 48 and the discharge-side pump 62 via the pump driving circuit 74 and generates the pressure that makes the ink circulate along the circulating path. At this time, the controller 70 opens all of the supply-side valves 52 through the valve driving circuit 76, opens all of the discharge-side valves 56 via the valve driving circuit 77, opens the second circulating valve 67 via the valve driving circuit 79, and closes the first circulating valve 66 via the valve driving circuit 78.

Thereby, the ink of each ink tank 21Y flows through the supply-side common flow path 47 and the supply-side individual flow path 51 and is supplied to the ink droplet ejecting modules 40. When the ink that is supplied to each ink droplet ejecting module 40 flows through the supply-side common flow path 47, the temperature of the ink is adjusted by the temperature adjustor 90.

A part of the ink that flows through the supply-side common flow path 47 flows to the discharge-side common flow path 53 through the second circulating path 69 and is returned to the ink tank 21Y.

The ink supplied to the ink droplet ejecting module 40 flows through the discharge-side individual flow path 57 and the discharge-side common flow path 53 and is returned to the ink tank 21Y. As such, the ink circulates along the circulating path.

In the first exemplary embodiment, since the part of the ink that flows through the supply-side common flow path 47 flows to the discharge-side common flow path 53 through the second circulating path 69, the flow rate of the ink increases at the downstream side of the supply-side common flow path 47, as compared with the case where the ink does not circulate in the second circulating path 69. Thereby, as compared with the case where the ink does not circulate in the second circulating path 69, the temperature variation of the ink in the supply-side common flow path 47 is suppressed, and the temperature variation of the ink between the ink droplet ejecting modules 40 is suppressed.

Figure 4:
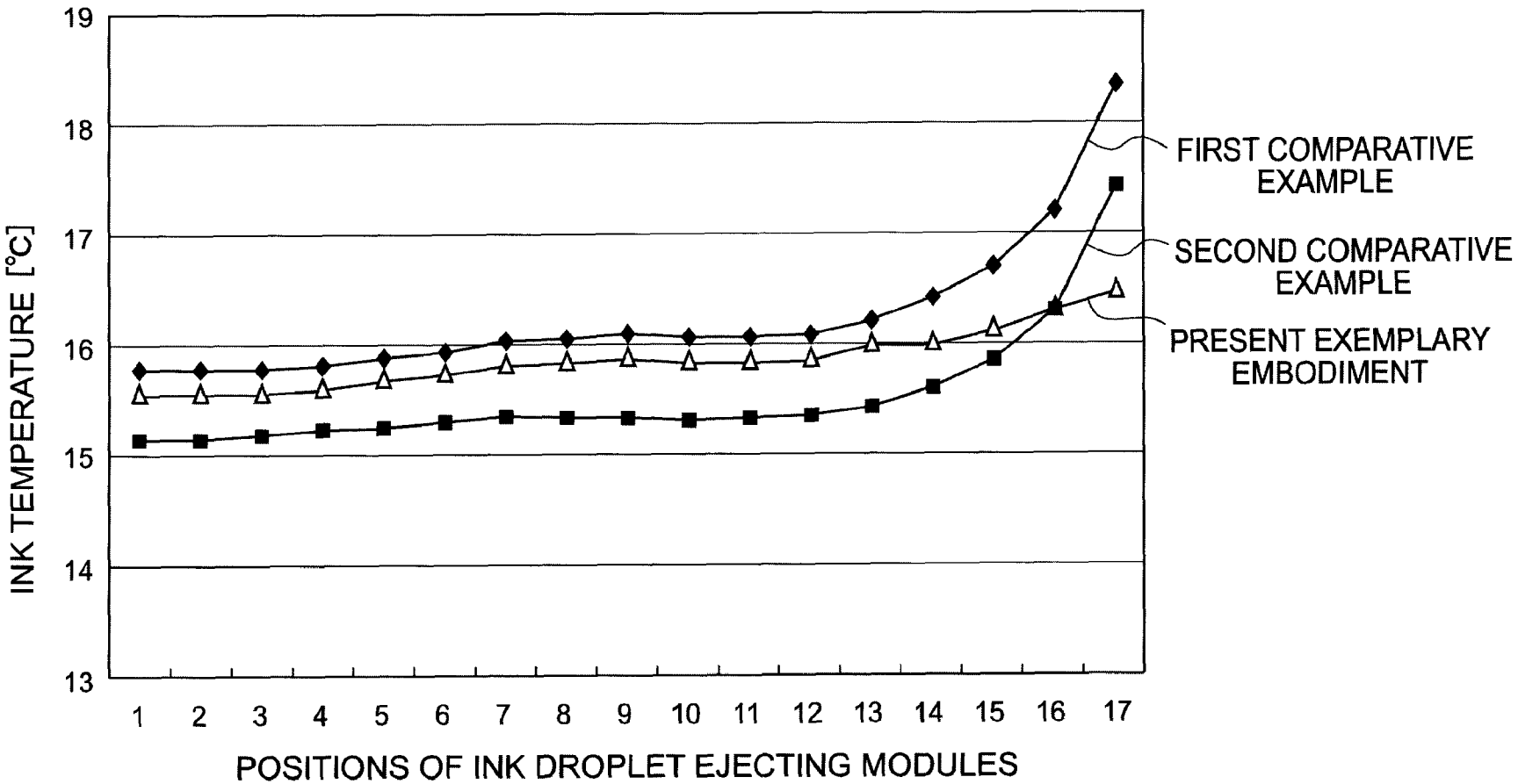
FIG. 4 is a graph illustrating temperature distributions of ink in supply-side common flow paths in the first exemplary embodiment and first and second comparative examples.

Temperature distributions of the ink in the supply-side common flow path 47 in the configurations of the present exemplary embodiment and first and second comparative examples will now be described. FIG. 4 is a graph illustrating temperature distributions of ink in the supply-side common flow path 47 in the present exemplary embodiment and the first and second comparative examples.

In the first comparative example, the second circulating tube 68 (second circulating path 69) is omitted from the configuration of the ink supply system 42 relating to the present exemplary embodiment (or the second circulating valve 67 is closed). In the second comparative example, the circulating flow rate is increased to be 1.5 times larger than that in the first comparative example.

The horizontal axis of the graph, "positions of the ink droplet ejecting modules", shows the ink droplet ejecting modules 40 disposed such that the closer to the supply-side pump 48, the smaller the number (indicates the ink droplet ejecting modules 40 disposed such that the closer to the second circulating path 69, the larger the number). A vertical axis of the graph "ink temperature" indicates the ink temperature in a connecting portion where the supply-side individual flow path 51 of the ink droplet ejecting module 40 is connected to the supply-side common flow path 47.

As illustrated in the graph of FIG. 4, in the first comparative example where the second circulating tube 68 (second circulating path 69) does not exist, when a number of the position of the ink droplet ejecting module 40 becomes larger, the ink temperature rises. This inclination is particularly noticeable in the ink droplet ejecting modules 40 having numbers 14 to 17 that are disposed to be distant from the supply-side pump 48. This inclination does not change even though the flow rate is increased to be 1.5 times lager than the existing flow rate, as in the second comparative example.

Meanwhile, in the first exemplary embodiment where the second circulating path 69 exists, the ink temperature is suppressed from rising, even though the number of the position of the ink droplet ejecting module 40 becomes larger.

Figure 5:
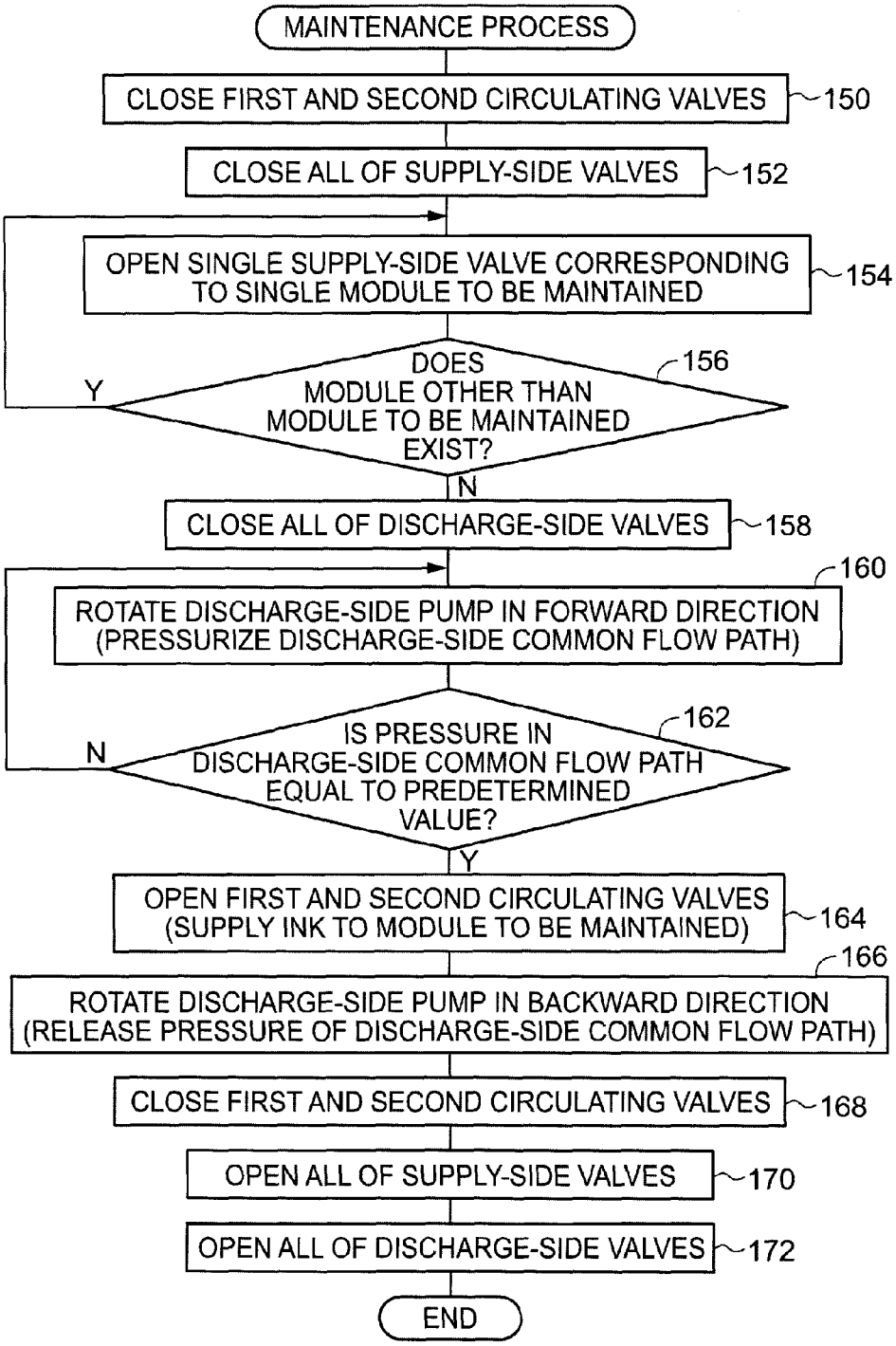
FIG. 5 is a flowchart illustrating a sequence of a maintenance process.

The maintenance operation of the ink droplet ejecting module 40 in the ink supply system 42 relating to the first exemplary embodiment will now be described. FIG. 5 is a flowchart illustrating a sequence of the maintenance process.

In the ink supply system 42 relating to the first exemplary embodiment, when a maintenance program is executed by the CPU 70A, the maintenance process of the ink droplet ejecting module 40 is executed by the controller 70.

In the maintenance process, first, in step S150, the first circulating valve 66 is closed via the valve driving circuit 78, and the second circulating valve 67 is closed via the valve driving circuit 79. Thereby, the circulation of the ink between the supply-side common flow path 47 and the discharge-side common flow path 53 is stopped.

Next, in step S152, all of the supply-side valves 52 that are provided in the individual supply-side individual tubes 50 are closed via the valve driving circuit 76. The closing operations of the supply-side valves 52 are preferably divided into several stages, similarly to steps S154 and S156 as described in detail below.

Next, in step S154, the single supply-side valve 52 that corresponds to the single ink droplet ejecting module 40 to be maintained is opened via the valve driving circuit 76.

Next, in step S156, it is determined whether other ink droplet ejecting modules 40 to be maintained exist. When the number of ink droplet ejecting modules 40 to be maintained is 1 or more, the determination result becomes NO. However, when the maintenances of the plural ink droplet ejecting modules 40 are to be performed, the determination result of step S156 becomes YES, and the process returns to step S154. The processes of steps S154 and S156 are repeated until the determination result of step S156 becomes YES.

In the first exemplary embodiment, when the supply-side valve 52 is opened in step S154, the ink is not supplied to the corresponding ink droplet ejecting module 40. As will be described below, when the first circulating valve 66 and the second circulating valve 67 are opened in a pressurization state, the ink is supplied to the ink droplet ejecting module 40 corresponding to the supply-side valve 52 in the opened state at that time. For this reason, in steps S154 and S156, the supply-side valves 52 corresponding to the ink droplet ejecting modules 40 to be maintained are individually opened. When one solenoid valve is openingly/closingly driven, a current of several hundreds of milliamperes flows. However, by individually opening the supply-side valves 52 as disclosed above, the maximum value of current that flows accompanying the opening of the supply-side valve 52 also becomes several hundreds of milliamperes. When the maintenances of the N ($N \geqq 2$) ink droplet ejecting modules 40 are performed, the maximum value of flowing current may be suppressed to 1/N, as compared with the case where the N supply-side valves 52 are simultaneously opened.

The present exemplary embodiment is not limited to the case where the supply-side valves 52 are individually opened. For example, when the N ($N \geqq 2$) supply-side valves 52 are to be opened, the opening operations of the N supply-side valves 52 may be divided into several stages, and the number of supply-side valves 52 that is to be opened at each time may not be constant.

When the supply-side valves 52 corresponding to all of the ink droplet ejecting modules 40 to be maintained are opened and the ink may be supplied to only the ink droplet ejecting modules 40 to be maintained among the ink droplet ejecting modules 40, the determination result of step S156 becomes NO and the process proceeds to step S158. All of the discharge-side valves 56 that are provided in the individual discharge-side individual tubes 55 are closed via the valve driving circuit 77. The closing operations of the discharge-side valves 56 are also preferably divided into several stages and individually performed in each step, similar to steps S154 and S156.

In step S160, the discharge-side pump 62 is made to rotate in a forward direction via the pump driving circuit 74. Accompanying the forward rotation of the discharge-side pump 62, a pressure (positive pressure) is applied to a section (hereinafter, referred to as pressurization section) between the first circulating valve 66 and the second circulating valve 67 and the discharge-side pump 62 in the common flow path formed by the supply-side common flow path 47, the discharge-side common flow path 53, the first circulating path 65, and the second circulating path 69, and the pressure in the pressurization section gradually increases as the forward rotation of the discharge-side pump 62 is continued. Next, in step S162, the detection result of the pressure of the pressurization section is obtained from the pressure sensor 82, and it is determined whether the pressure in the pressurization section that is indicated by the obtained detection result reaches a setting value set in advance as the pressure at the time of the maintenance. When the determination result becomes NO, the process returns to step S160, and the processes of steps S160 and S162 are repeated until the determination result of step S162 becomes YES.

When the pressure in the pressurization section reaches the setting value, the determination result of step S162 becomes YES and the process proceeds to step S164. The first circulating valve 66 is opened via the valve driving circuit 78, and the second circulating valve 67 is opened via the valve driving circuit 79. Thereby, the pressure (positive pressure) that is accumulated in the pressurization section is transmitted to the supply-side common flow path 47 via the first circulating path 65 and the second circulating path 69, and the pressure (positive pressure) is also applied to the supply-side common flow path 47. At this time, however, since the supply-side valve 52 corresponding to the ink droplet ejecting module 40 to be maintained is opened, the ink is supplied to the ink droplet ejecting module 40 to be maintained by the pressure (positive pressure) applied to the supply-side common flow path 47. In a case where plural ink droplet ejecting modules 40 to be maintained (ink droplet ejecting modules 40 where the corresponding supply-side valves 52 are opened) exist, the ink is simultaneously supplied to the plural ink droplet ejecting modules 40 to be maintained.

The supply of ink to the ink droplet ejecting modules 40 may be urged by operating the supply-side pump 48 and the discharge-side pump 62.

In step S164, the ink droplets are ejected from all of the nozzles of the ink droplet ejecting modules 40 to be maintained. At this time, however, since all of the discharge-side valves 56 including the discharge-side valves 56 that correspond to the ink droplet ejecting modules 40 to be maintained are closed, the ink (ink whose deterioration degree is relatively large) that remains in the ink droplet ejecting modules 40 to be maintained is completely ejected (discharged) as the ink droplets from the nozzles of the ink droplet ejecting modules 40 to be maintained, and the ink in the ink droplet ejecting modules 40 to be maintained is exchanged with ink having a high cleaning level that is newly supplied to the ink droplet ejecting modules 40 to be maintained.

In the first exemplary embodiment, the ink droplet ejecting module 40 for maintenance is selected by opening the supply-side valve 52, and the supply of the ink to the selected ink droplet ejecting module is achieved by opening the first circulating valve 66 and the second circulating valve 67. Therefore, even when the number of ink droplet ejecting modules 40 to be maintained is plural, the maintenance (ink supply) of the ink droplet ejecting modules 40 to be maintained may be simultaneously performed without simultaneously opening the supply-side valves 52 corresponding to the ink droplet ejecting modules 40 to be maintained. When the maintenance (ink supply) of the ink droplet ejecting modules 40 to be maintained is simultaneously performed by opening the first circulating valve 66 and the second circulating valve 67, as an initial pressure of the ink, pressure having little variation is applied to the individual ink droplet ejecting modules 40 to be maintained. During the maintenance, maintenance is performed such that the pressure of the ink that is supplied to the ink droplet ejecting modules 40 varies little between the individual ink droplet ejecting modules 40.

In step S164, the controller 70 causes the maintenance unit to execute the maintenance process with respect to the ink droplet ejecting modules 40 to be maintained. Thereby, the ink droplets that are ejected (discharged) from the nozzles of the ink droplet ejecting modules 40 to be maintained adhere to the receiving member of the maintenance unit, the ink droplets are prevented from flying in all directions, and the nozzle surfaces of the ink droplet ejecting modules 40 to be maintained are cleaned by the cleaning member of the maintenance unit. Accompanying a driving signal being supplied to the ejecting mechanism, the ink droplet ejecting module 40 to be maintained returns to a state where the ink droplets correctly corresponding to the supplied driving signal may be ejected.

In this way, when the maintenance is completed with respect to the ink droplet ejecting modules 40 to be maintained, the discharge-side pump 62 is caused to rotate in a backward direction for a short time by the pump driving circuit 74 in a next step S166, and the first circulating valve 66 and the second circulating valve 67 are closed in step S168. Thereby, the pressure (positive pressure) that is applied to the common flow path is released. Further, the supply of the ink to the ink droplet ejecting modules 40 to be maintained is stopped. In step S170, all of the supply-side valves 52 are opened via the valve driving circuit 76. Next, in step S172, all of the discharge-side valves 56 are opened via the valve driving circuit 77, and the maintenance process ends. As in steps S154 and S156 described above, the opening operations to the supply-side valves 52 and the discharge-side valves 56 are preferably divided into several stages.

Second Exemplary Embodiment

Figure 6:
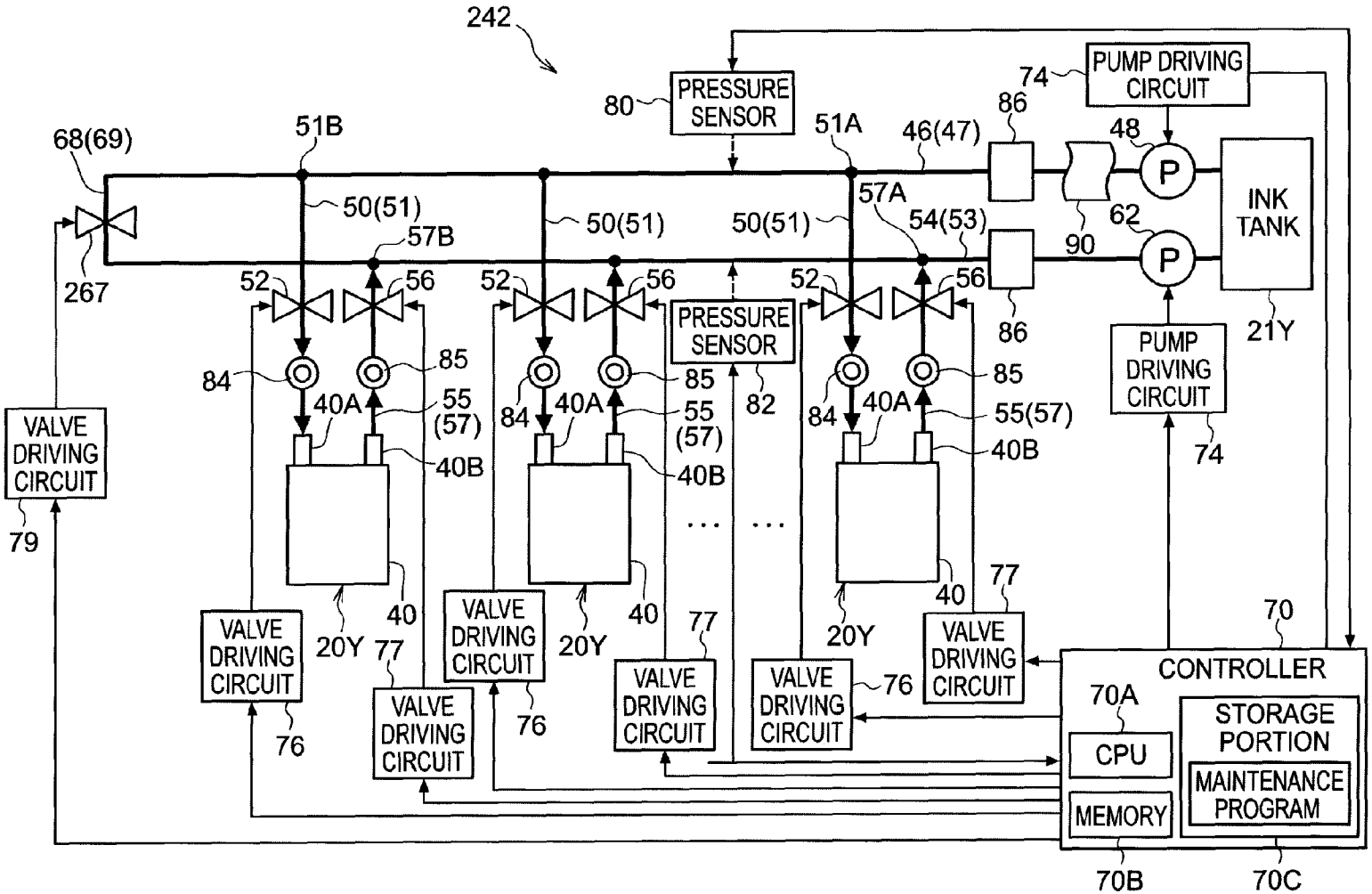
FIG. 6 is a schematic view illustrating the configuration of an ink supply system relating to a second exemplary embodiment of the present invention.

The second exemplary embodiment will now be described. The same components as those in the first exemplary embodiment are denoted by the same reference numerals, and only the configurations that are different from those in the first exemplary embodiment are described. FIG. 6 illustrates a schematic configuration of an ink supply system 242 relating to the second exemplary embodiment.

The ink supply system 242 relating to the second exemplary embodiment is different from the ink supply system 42 relating to the first exemplary embodiment in that, instead of the second circulating valve 67, a switching valve 267 serving as an example of a switching mechanism that may switch the flow path resistance of the second circulating path 69 (one example of the circulating path) into a first resistance and a second resistance is provided, and the first circulating tube 64 (first circulating path 65), the first circulating valve 66, and the valve driving circuit 78 are omitted.

The switching valve 267 compresses the second circulating tube 68 that is composed of a flexible tube, changes the flow path width (diameter of the second circulating tube 68) of the ink of the second circulating path 69, and thereby switching the flow path resistance of the second circulating path 69. Specifically, a state of the switching valve 267 may be adjusted to a first state where the second circulating path 69 is applied with a predetermined first flow path resistance and a second state where the second circulating path 69 is applied with a second flow path resistance larger than the first flow path resistance. In the first state, the flow path resistance of the second circulating path 69 is set so as to be suitable for the maintenance operation. In the second state, the flow path resistance of the second circulating path 69 is determined by the circulating flow rates of the respective modules and the temperature distributions of the ink in the supply-side common flow path 47. The switching valve 267 may be configured to adjust the flow path resistance of the second circulating path 69 depending on an opening thereof.

The switching valve 267 functions as an opening/closing mechanism that further compresses the second circulating tube 68 to block the second circulating path 69, and releases the compression to open/close the second circulating path 69.

In the configuration of the second exemplary embodiment, during a period when the maintenance is not performed (for example, an image recording period when the image is recorded on the recording medium P or a waiting period when the image is not recorded), the controller 70 activates the supply-side pump 48 and the discharge-side pump 62 via the pump driving circuit 74 and generates the pressure that makes the ink circulate along the circulating path. At this time, the controller 70 opens all of the supply-side valves 52 via the valve driving circuits 76 and opens all of the discharge-side valves 56 via the valve driving circuits 77. The controller 70 activates the switching valve 267 via the valve driving circuit 79 and enters in the second state. Thereby, the ink circulates along the circulating path.

Meanwhile, instead of the process (steps S150 and S168) that closes the first circulating valve 66 and the second circulating valve 67 in the maintenance operation of the first embodiment, in the maintenance operation of the second exemplary embodiment, a process that closes the switching valve 267 is executed, although not illustrated in the drawings. Instead of the process (S164) that opens the first circulating valve 66 and the second circulating valve 67, a process that opens the switching valve 267 to enter in the first state is executed.

As such, according to the configuration of the second exemplary embodiment, since the first circulating path 65 becomes unnecessary, the configuration of the ink supply system may be simplified. Instead of the plural valves (the first circulating valve 66 and the second circulating valve 67), operations can be achieved with only one valve (switching valve 267).

The configuration that switches the flow path resistance of the second circulating path 69 and the configuration that opens/closes the second circulating path 69 may be different configurations. The mechanism that opens/closes the second circulating path 69 may be separately provided from the switching valve 267.

Figure 7:
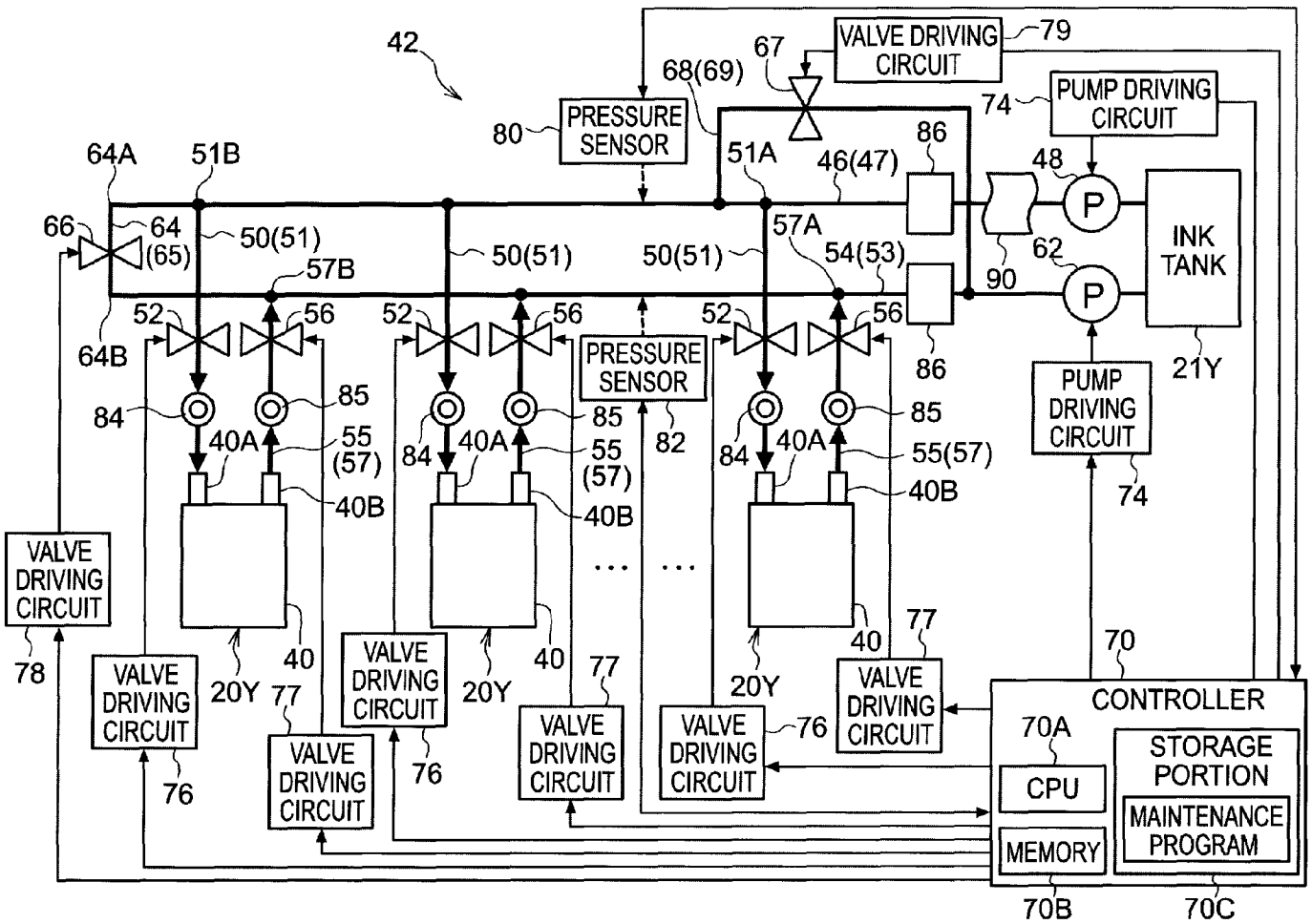
FIG. 7 is a schematic view illustrating a modification of connection of a second circulating path.

In the first and second exemplary embodiments, the upstream end portion of the second circulating path 69 is connected to the supply-side common flow path 47 further downstream than the connecting portion 64A of the first circulating tube 64 to the supply-side common tube 46, and the downstream end portion of the second circulating path 69 is connected to the discharge-side common flow path 53 further upstream than the connecting portion 64B of the first circulating tube 64 to the discharge-side common tube 54. However, the second circulating path 69 may be connected as illustrated in FIG. 7. The configuration in FIG. 7 is applied to the first exemplary embodiment, but may be applied to the second exemplary embodiment.

In the configuration illustrated in FIG. 7, the upstream end portion of the second circulating path 69 is connected to the downstream side of the connecting portion 51A of the supply-side individual flow path 51, and the downstream end portion of the second circulating path 69 is connected between the discharge-side pump 62 and the sub-tank 86 in the discharge-side common flow path 53.

As such, the upstream end portion of the second circulating path 69 may be connected to a further downstream side than the connecting portion 51A of the supply-side individual flow path 51, and the downstream end portion of the second circulating path 69 may be connected to any place, as long as the place is further upstream than the discharge-side pump 62 in the discharge-side common flow path 53.

Figure 8:
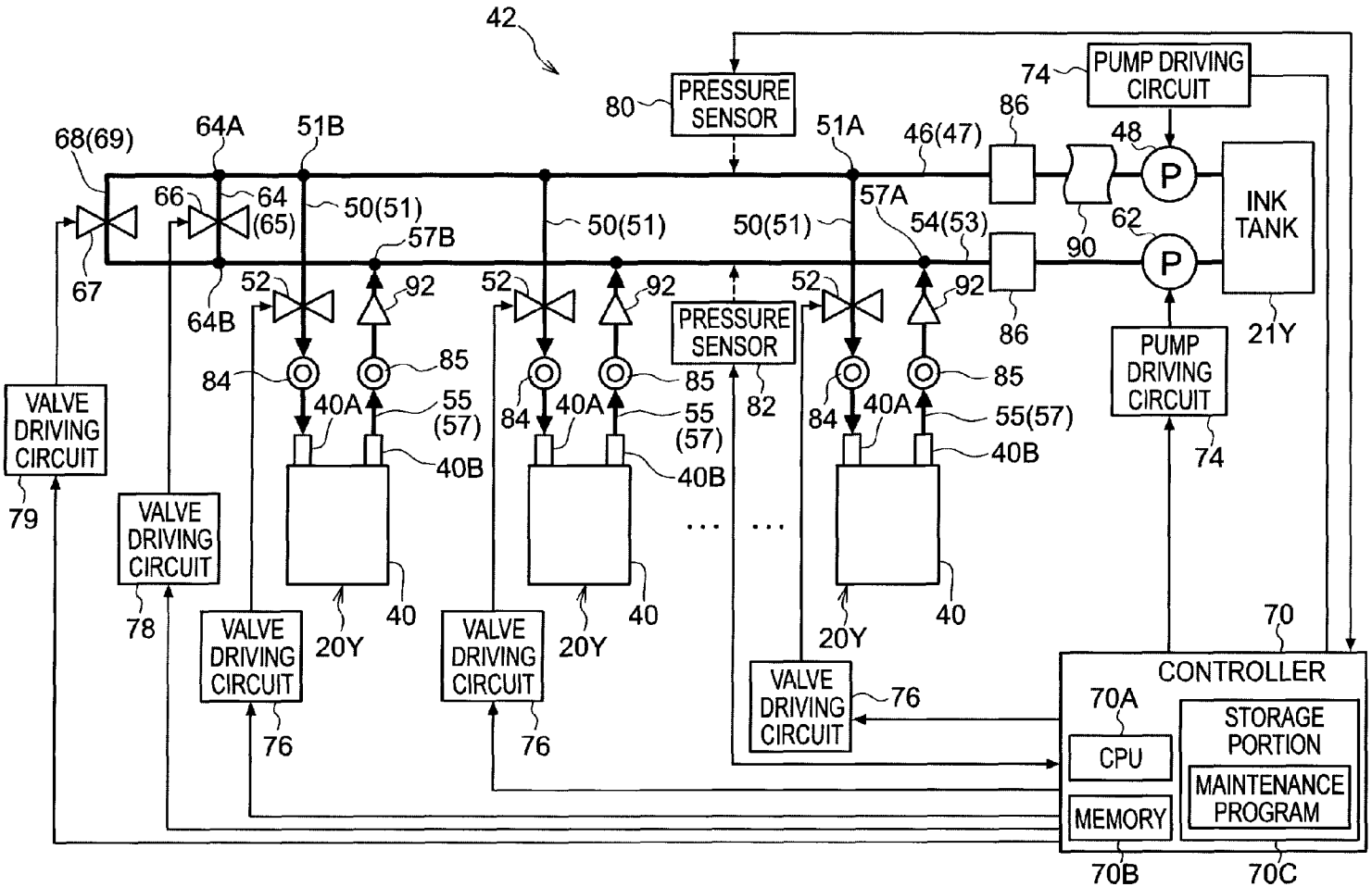
FIG. 8 is a schematic view illustrating a medication wherein a one-way valve is provided, instead of a discharge-side valve.

In the first and second exemplary embodiments, as illustrated in FIG. 8, a one-way valve 92 may be provided, instead of the discharge-side valve 56. The configuration in FIG. 8 is applied to the first exemplary embodiment, but may be applied to the second exemplary embodiment.

Figure 9A:
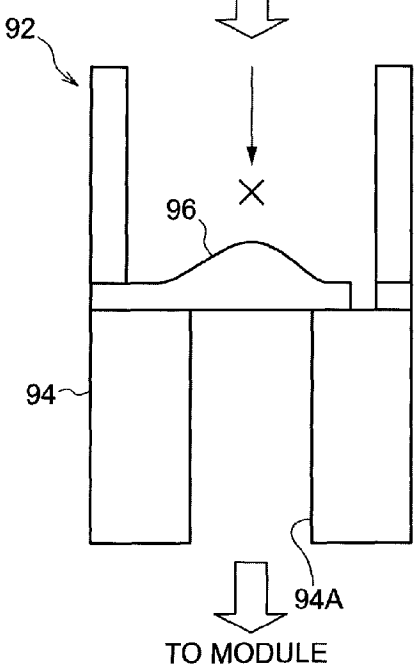
FIG. 9A is a schematic view illustrating the configuration of the one-way valve of FIG. 8.
Figure 9B:
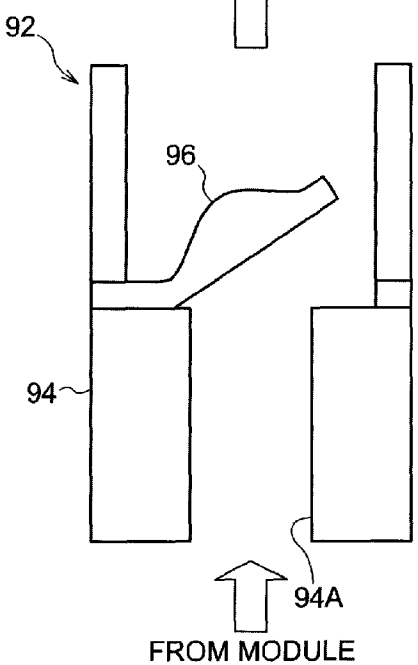
FIG. 9B is a schematic view illustrating the configuration of the one-way valve of FIG. 8.
Figure 9C:
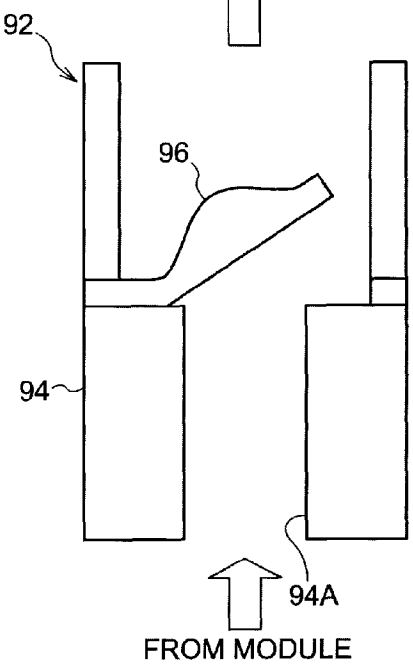
FIG. 9C is a schematic view illustrating the configuration of the one-way valve of FIG. 8.

The one-way valve 92 allows the ink to circulate from the ink droplet ejecting module 40 to the discharge-side common tube 54 side, while prohibits the ink from circulating from the discharge-side common tube 54 side to the ink droplet ejecting module 40. For example, the one-way valve 92 includes a stop member 94 and a valve body 96, as illustrated in FIGS. 9A to 9C. The stop member 94 is column-shaped and has a through-hole 94A along an axis line so as to allow the ink to circulate through the through-hole 94A. The valve body 96 is made of a flexible material and has a flat shape configured to cover the entire surface of the opening of the through-hole 94A. One end portion (base portion) of the valve body 96 is fixed on one end surface of the stop member 94, and a middle portion thereof is bent such that the other end portion (distal portion) is positioned at an opening position separated by a predetermined interval from the one end surface of the stop member 94 (also see FIGS. 9B and 9C).

Thereby, in a case where the ink does not flow through the discharge-side individual tube 55 or the pressure difference of the ink droplet ejecting module 40 and the discharge-side common tube 54 with the one-way valve 92 therebetween is not generated, the valve body 96 is positioned at the opening position where the distal portion of the valve body 96 is apart from the one end surface of the stop member 94, as illustrated in FIG. 9C. Even in a case where the ink flows from the ink droplet ejecting module 40 side to the discharge-side common tube 54 side in the discharge-side individual tube 55, the valve body 96 is maintained at the opening position, as illustrated in FIG. 9B. Meanwhile, in a case where the ink flows from the discharge-side common tube 54 side to the ink droplet ejecting module 40 side in the discharge-side individual tube 55, the valve body 96 is pushed to the ink droplet ejecting module 40 side by the ink flowing-in from the discharge-side common tube 54 side to the one-way valve 92. As illustrated in FIG. 9A, the valve body 96 is displaced such that the distal portion of the valve body 96 moves to a closing position where the distal portion contacts the one end surface of the stop member 94, and due thereto, the circulation of the ink from the discharge-side common tube 54 side to the ink droplet ejecting module 40 side in the discharge-side individual tube 55 is stopped.

As such, the discharge-side individual tube 55 is closed or opened by only rotating the existing discharge-side pump 62 in the forward or backward direction using the one-way valve 92. Therefore, the valve driving circuit 77 becomes unnecessary, and the configuration is simplified.

The invention is not limited to the exemplary embodiments, and various changes, modifications, and improvements may be made.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting apparatus, comprising:

a plurality of liquid droplet ejecting portions, each including a supply port supplying a liquid from outside and a discharge port discharging the liquid supplied through the supply port, and each ejecting the liquid supplied through the supply port as liquid droplets;

supply-side individual flow paths being connected to the respective supply ports of the plurality of liquid droplet ejecting portions and allowing the liquid to flow to the supply ports;

discharge-side individual flow paths being connected to the respective discharge ports of the plurality of liquid droplet ejecting portions and allowing the liquid discharged from the discharge ports to flow;

a supply-side common flow path connecting with a plurality of the supply-side individual flow paths and allowing the liquid to flow to the plurality of supply-side individual flow paths;

a discharge-side common flow path connecting with a plurality of the discharge-side individual flow paths and allowing the liquid from the plurality of discharge-side individual flow paths to flow;

first opening/closing mechanisms being disposed in the plurality of supply-side individual flow paths and opening/closing the plurality of supply-side individual flow paths;

second opening/closing mechanisms being disposed in the plurality of discharge-side individual flow paths and opening/closing the plurality of discharge-side individual flow paths;

a first pressure applying portion being disposed in the supply-side common flow path and applying pressure to the supply-side common flow path;

a second pressure applying portion being disposed in the discharge-side common flow path and applying pressure to the discharge-side common flow path;

a first circulating path circulating the liquid between the supply-side common flow path and the discharge-side common flow path;

a third opening/closing mechanism being disposed in the first circulating path and opening/closing the first circulating path;

a second circulating path including an upstream end portion being connected to the supply-side common flow path further downstream than a connecting portion of a supply-side individual flow path connected to the supply-side common flow path at a furthest upstream side in a liquid circulating direction and a downstream end portion being connected to the discharge-side common flow path, and circulating the liquid between the supply-side common flow path and the discharge-side common flow path; and a fourth opening/closing mechanism being disposed in the second circulating path and opening/closing the second circulating path.

2. The liquid droplet ejecting apparatus of claim 1, wherein the upstream end portion of the second circulating path is connected to the supply-side common flow path further downstream than a connecting portion of a supply-side individual flow path connected to the supply-side common flow path at a furthest downstream side in the liquid circulating direction.

3. The liquid droplet ejecting apparatus of claim 1, wherein a flow path resistance of the first circulating path is different from a flow path resistance of the second circulating path.

4. The liquid droplet ejecting apparatus of claim 2, wherein the flow path resistance of the first circulating path is different from the flow path resistance of the second circulating path.

5. A liquid droplet ejecting apparatus, comprising:

a plurality of liquid droplet ejecting portions, each including a supply port supplying a liquid from outside and a discharge port discharging the liquid supplied through the supply port, and each ejecting the liquid supplied through the supply port as liquid droplets;

supply-side individual flow paths being connected to the respective supply ports of the plurality of liquid droplet ejecting portions and allowing the liquid to flow to the supply ports;

discharge-side individual flow paths being connected to the respective discharge ports of the plurality of liquid droplet ejecting portions and allowing the liquid discharged from the discharge ports to flow;

a supply-side common flow path connecting with a plurality of the supply-side individual flow paths and allowing the liquid to flow to the plurality of supply-side individual flow paths;

a discharge-side common flow path connecting with a plurality of the discharge-side individual flow paths and allowing the liquid from the plurality of discharge-side individual flow paths to flow;

first opening/closing mechanisms being disposed in the plurality of supply-side individual flow paths and opening/closing the supply-side individual flow paths;

second opening/closing mechanisms being disposed in the plurality of discharge-side individual flow paths and opening/closing the discharge-side individual flow paths;

a first pressure applying portion being disposed in the supply-side common flow path and applying pressure to the supply-side common flow path;

a second pressure applying portion being disposed in the discharge-side common flow path and applying pressure to the discharge-side common flow path;

a circulating path including an upstream end portion being connected to the supply-side common flow path further downstream than a connecting portion of a supply-side individual flow path connected to the supply-side common flow path at a furthest upstream side in a liquid circulating direction and a downstream end portion being connected to the discharge-side common flow path, and circulating the liquid between the supply-side common flow path and the discharge-side common flow path;

a third opening/closing mechanism being disposed in the circulating path and opening/closing the circulating path; and a switching mechanism being disposed in the circulating path and switching a flow path resistance of the circulating path between a first resistance and a second resistance.

6. The liquid droplet ejecting apparatus of claim 5, wherein the upstream end portion of the circulating path is connected to the supply-side common flow path further downstream than a connecting portion of a supply-side individual flow path connected to the supply-side common flow path at a furthest downstream side in the liquid circulating direction.

7. The liquid droplet ejecting apparatus of claim 5, wherein the switching mechanism functions as the third opening/closing mechanism.

8. The liquid droplet ejecting apparatus of claim 6, wherein the switching mechanism functions as the third opening/closing mechanism.

* * * * *